US007471039B2

(12) United States Patent
Lin et al.

(10) Patent No.: US 7,471,039 B2
(45) Date of Patent: Dec. 30, 2008

(54) QUADRODE FIELD EMISSION DISPLAY

(75) Inventors: Biing-Nan Lin, Hsinchu (TW); Cheng-Chung Lee, Hsinchu (TW); Yu-Yang Chang, Hsinchu (TW); Wei-Yi Lin, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 39 days.

(21) Appl. No.: 11/201,418

(22) Filed: Aug. 11, 2005

(65) Prior Publication Data

US 2006/0238104 A1 Oct. 26, 2006

(30) Foreign Application Priority Data

Apr. 20, 2005 (TW) ..... 94112627 A

(51) Int. Cl.
*H01J 1/304* (2006.01)

(52) U.S. Cl. ..... 313/497; 313/495

(58) Field of Classification Search ..... 315/169.1, 315/169.2, 169.3, 169.4; 313/310, 292, 495–497, 313/414, 346 R
See application file for complete search history.

(56) References Cited

U.S. PATENT DOCUMENTS

| | | | | |
|---|---|---|---|---|
| 6,045,426 | A | 4/2000 | Wang et al. | 455/24 |
| 6,359,383 | B1 | 3/2002 | Chuang et al. | 313/496 |
| 6,747,416 | B2 * | 6/2004 | Barger et al. | 315/169.3 |
| 6,791,278 | B2 * | 9/2004 | Russ et al. | 315/169.3 |
| 6,873,118 | B2 * | 3/2005 | Russ et al. | 315/169.3 |
| 7,002,290 | B2 * | 2/2006 | Russ et al. | 313/497 |
| 7,064,493 | B2 * | 6/2006 | Konishi | 315/169.1 |

* cited by examiner

*Primary Examiner*—Nimeshkumar D Patel
*Assistant Examiner*—Christopher M Raabe
(74) *Attorney, Agent, or Firm*—Harness, Dickey & Pierce PLC

(57) ABSTRACT

A quadrode field emission display is provided, where a low driving voltage is reached by an edge structure, and display in the dark is achieved by adding a sub-gate electrode. With respect to the electrical characteristics that an edge structure may raise the electric field intensity, an edge of a cathode plate through an opening of a gate layer is exposed, thereby forming the edge structure at an emitter to raise the electric field. It also reduces the driving voltage substantially. Therefore, the display in the dark is achieved by adjusting the voltage without changing the structure.

9 Claims, 8 Drawing Sheets

QUADRODE FIELD EMISSION DISPLAY

BACKGROUND

1. Field of Invention

The invention relates to a field emission display (FED), and more particularly to a field emission display with a quadrode structure.

2. Description of the Related Art

In a field emission display (FED), voltage is applied to a cathode and a gate electrode in a vacuum to create an electric field for inducing electrons at the tip of some material, and then the field-emitted electrons left from the cathode plate are accelerated toward the anode since positive voltage on the anode attracts, and collide with phosphors, thereby emitting luminescence.

Referring to FIG. 1, the FED has an anode plate 10 and a cathode plate 20 between which a vacuum cavity is formed. In the anode plate 10, an anode electrode layer 12 and a luminescent layer 13 are formed under a glass substrate 11 in order. In the cathode plate 20, a cathode electrode layer 22 is formed on a glass substrate 21, and a field-emitted array 23 having a two dimension distributions is disposed on the cathode electrode layer 22. On each array unit is disposed a gate layer 24 having a hole 25, inside which there is a metallic taper on the cathode electrode layer 22, and the gate layer 24 and the sides of the metallic taper are separated by an insulation layer 26. Due to the array properties for a conventional field emission display, the structure needs to be implemented through expensive lithography and deposition, and the sizes of finished displays are seriously limited. Therefore, new materials and new processes have been developed.

As shown in FIG. 2, an FED, disclosed in U.S. Pat. No. 6,359,383, not only utilizes a nanotube instead of conventionally electronic emitter, but also provides a new structure of the FED. It includes an anode plate 30, a cathode plate 40 separated from the anode plate 30 and comprising a cathode electrode layer 41, a resistive layer 42 and a nanotube emitter 43, which is disposed on the top layer of the cathode plate 40 to perform the field emission, in sequence, an insulation substrate 50 on which the cathode plate 40 is disposed, a gate layer 60 disposed at two sides of the nanotube emitter 43 on the cathode plate 40, and a dielectric substrate 70 separating the cathode plate 40 from the gate layer 60. The FED with the above-mentioned structure can be implemented through a simple thin film printing technique that reduces cost. However, it is necessity to find a preferable solvent if the driving voltage of the FED is reduced further to accelerate the development of the driving system.

Furthermore, as shown in FIG. 3—the FED disclosed in U.S. Pat. No. 6,359,383—besides having three electrodes (i.e. a cathode 80, a gate electrode 82 and an anode [not shown]) as in prior art, it has a fourth electrode (i.e. a focus electron 84) above a gate electrode 82 for focusing electrons to improve the problem of diverging the electron beam, (thereby preventing power consumption such as to use lower driving voltage.)—(this makes no sense) However, in this case, there is a problem that the electrode may release current in the dark. Therefore, the image quality for the FED needs to be improved.

SUMMARY

Accordingly, the invention is directed to a quadrode field emission display (quadrode FED), which differs from a conventional quadrode structure, and which has an emitter with an edge structure to reduce the driving voltage and to display perfectly in the dark, thereby substantially solve the problems of the prior art.

To achieve these and other advantages and in accordance with the purpose of the invention, as embodied and broadly described, a quadrode field emission display comprises an insulation substrate, a cathode and sub-gate layer, a gate layer, a dielectric layer and an anode plate. The insulation substrate acts as a cathode substrate. The cathode and sub-gate layer include a cathode plate and a sub-gate electrode, which are disposed on the insulation substrate at a distance from one another. Normally, the voltage at the sub-gate electrode is slightly higher than the voltage at the cathode plate, such that electrons released from the cathode plate are attracted and led to the sub-gate electrode. The gate layer is disposed on the cathode plate, and has an opening pierced through the gate layer to expose an edge of the cathode plate, so as to induce the cathode plate to excite the electrons. The dielectric layer separates the cathode plate and the sub-gate electrode from the gate layer. The anode plate is disposed above the gate layer, so that the excited electrons are emitted and collide with the anode plate.

The anode plate comprises a light-transmitting substrate, an anode electrode layer that is disposed under the light-transmitting substrate, and a light emitting layer that is disposed under the anode electrode. The cathode plate is formed with a cathode electrode layer, a resistive layer formed on the cathode electrode layer and an emitter formed on the resistive layer. The emitter of the cathode plate emits the electrons as voltages at the anode plate and the gate layer attract, and then the electrons collide with the light emitting layer on the anode plate, such that the light emitting layer excites light, and then the light from the light emitting layer travels through the light-transmitting substrate and is emitted. On the other hand, when the driving voltage is not applied, the sub-gate electrode attracts the electrons released from the emitter to prevent the electrons from colliding with the anode plate, such that the quadrode FED does not radiate light, thereby implementing the perfect display inr the dark.

In a quadrode field emission display according to invention, there is an edge structure at the emitter to enhance effectively the electric field intensity. Furthermore, the opening of the gate plate may just expose the edge of the cathode plate, or expose simultaneously the edge of the cathode plate and the edge of the sub-gate electrode, by which the same purpose is reached.

BRIEF DESCRIPTION OF THE DRAWINGS

The invention will become more fully understood from the detailed description given herein below, which is for illustration only and thus is not limitative of the invention, wherein.

DETAILED DESCRIPTION OF THE INVENTION

Figure 1:
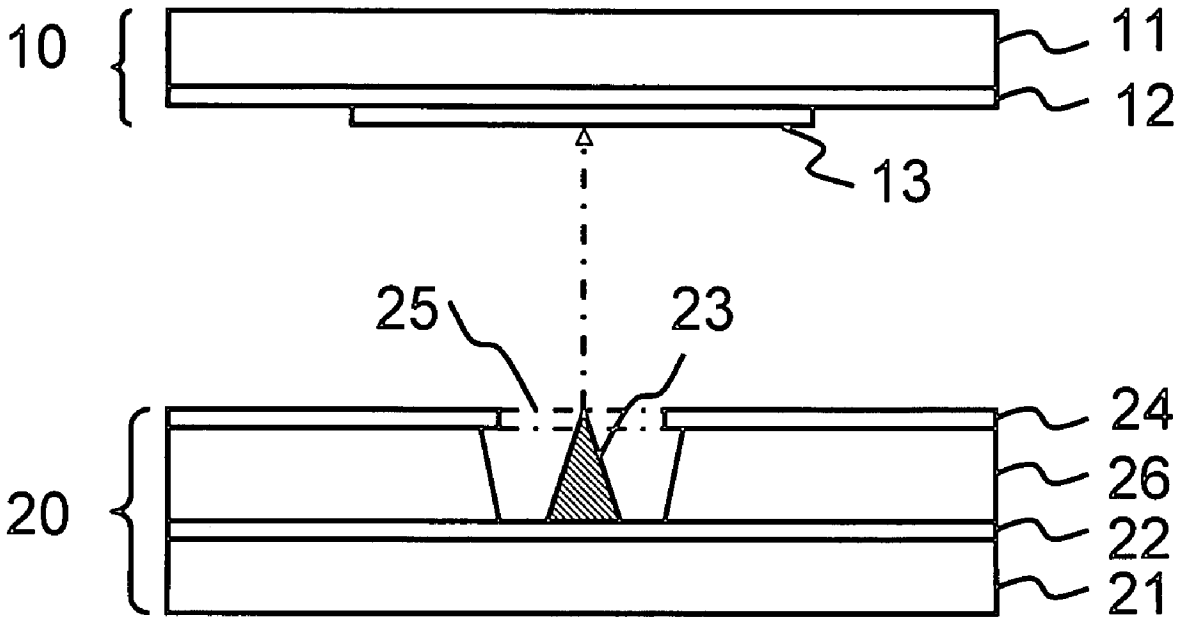
FIG. 1 (PRIOR ART)
FIG. 1 shows a basic structure of a conventional field emission display.
Figure 2:
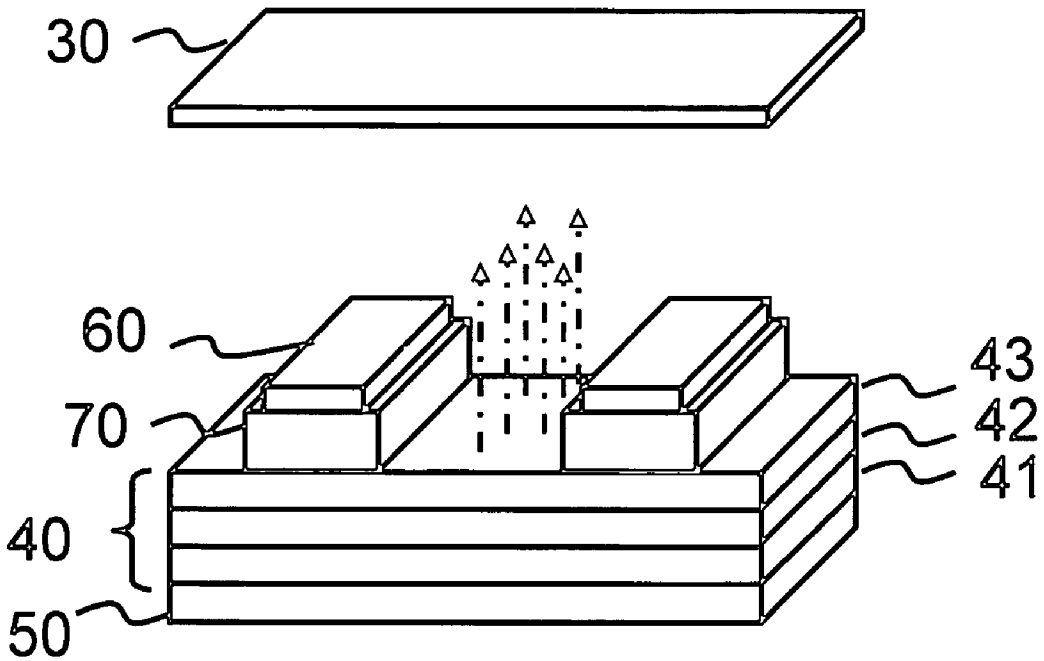
FIG. 2 (PRIOR ART)
FIG. 2 is a schematic view showing another conventional field emission display.
Figure 3:
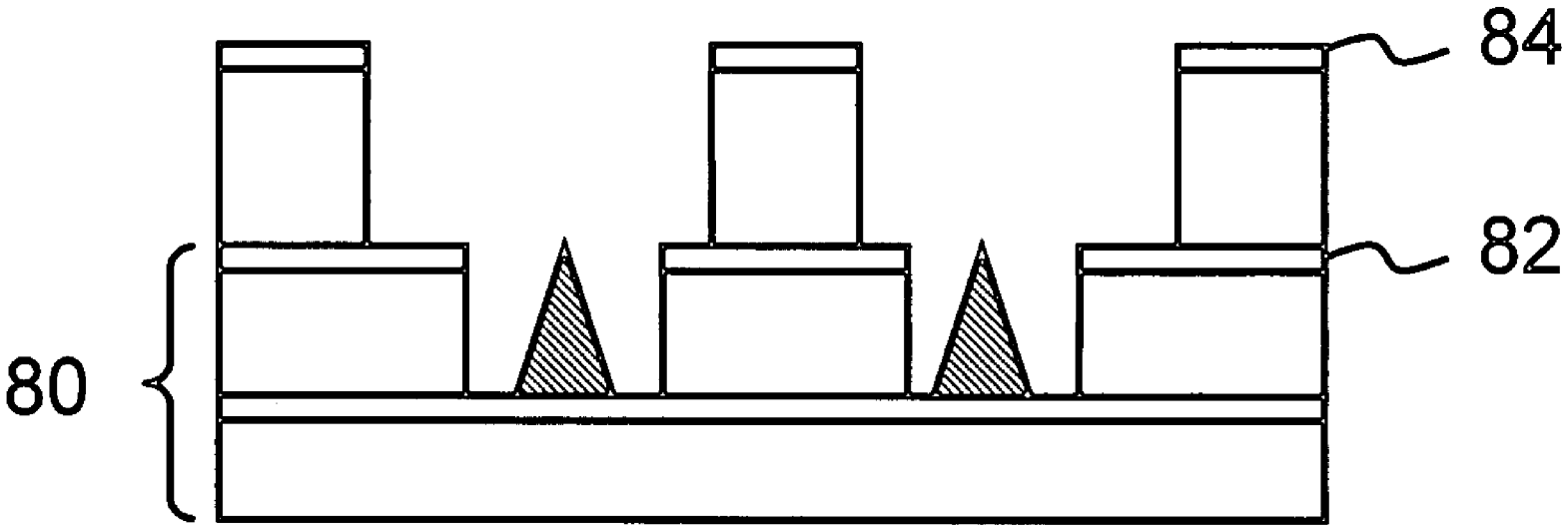
FIG. 3 (PRIOR ART)
FIG. 3 is a schematic view showing cathodes of yet another conventional field emission display.
Figure 4A:
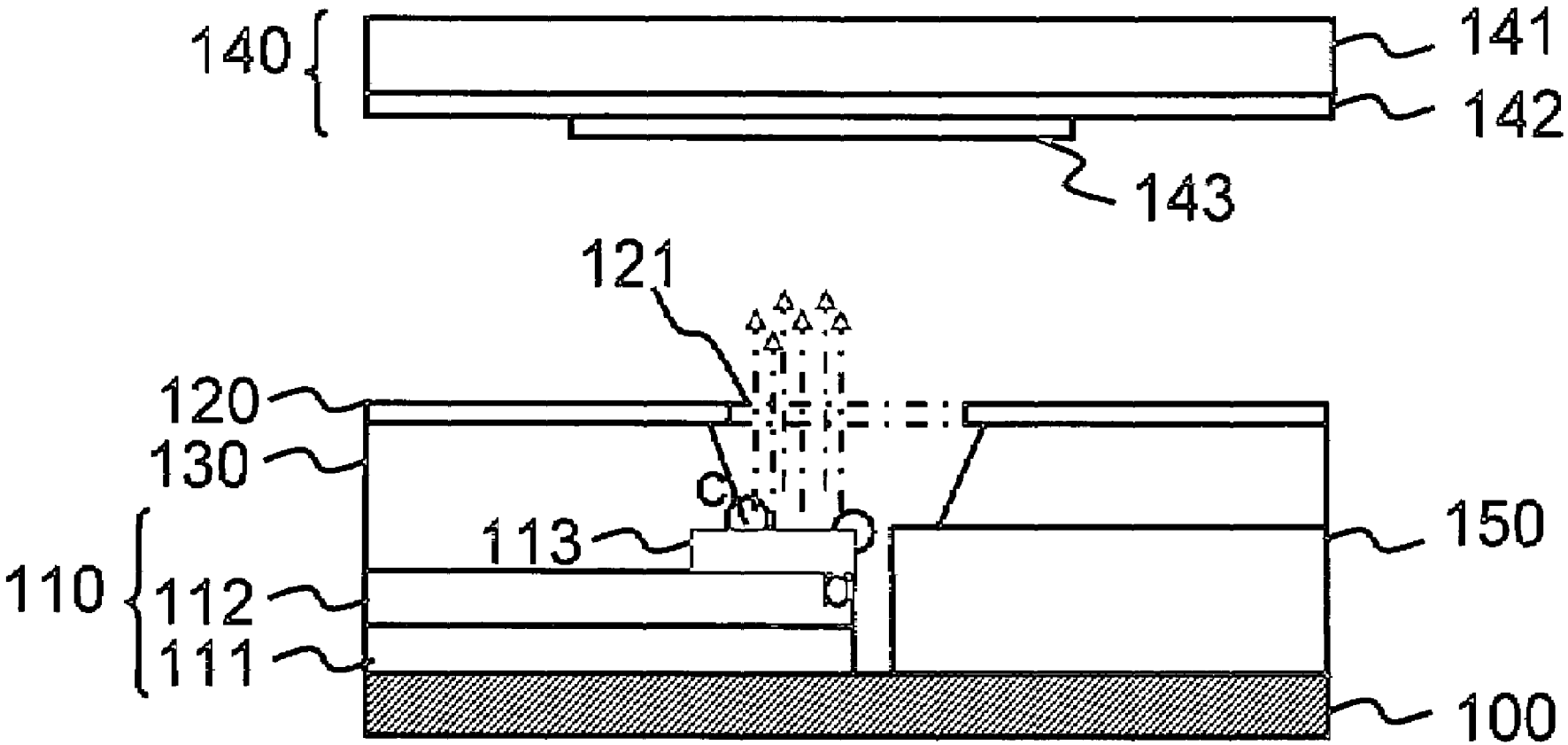
FIGS. 4A and 4B are a cross-sectional view and an upward view showing a quadrode field emission display according to a first embodiment of the invention, respectively.
Figure 4B:
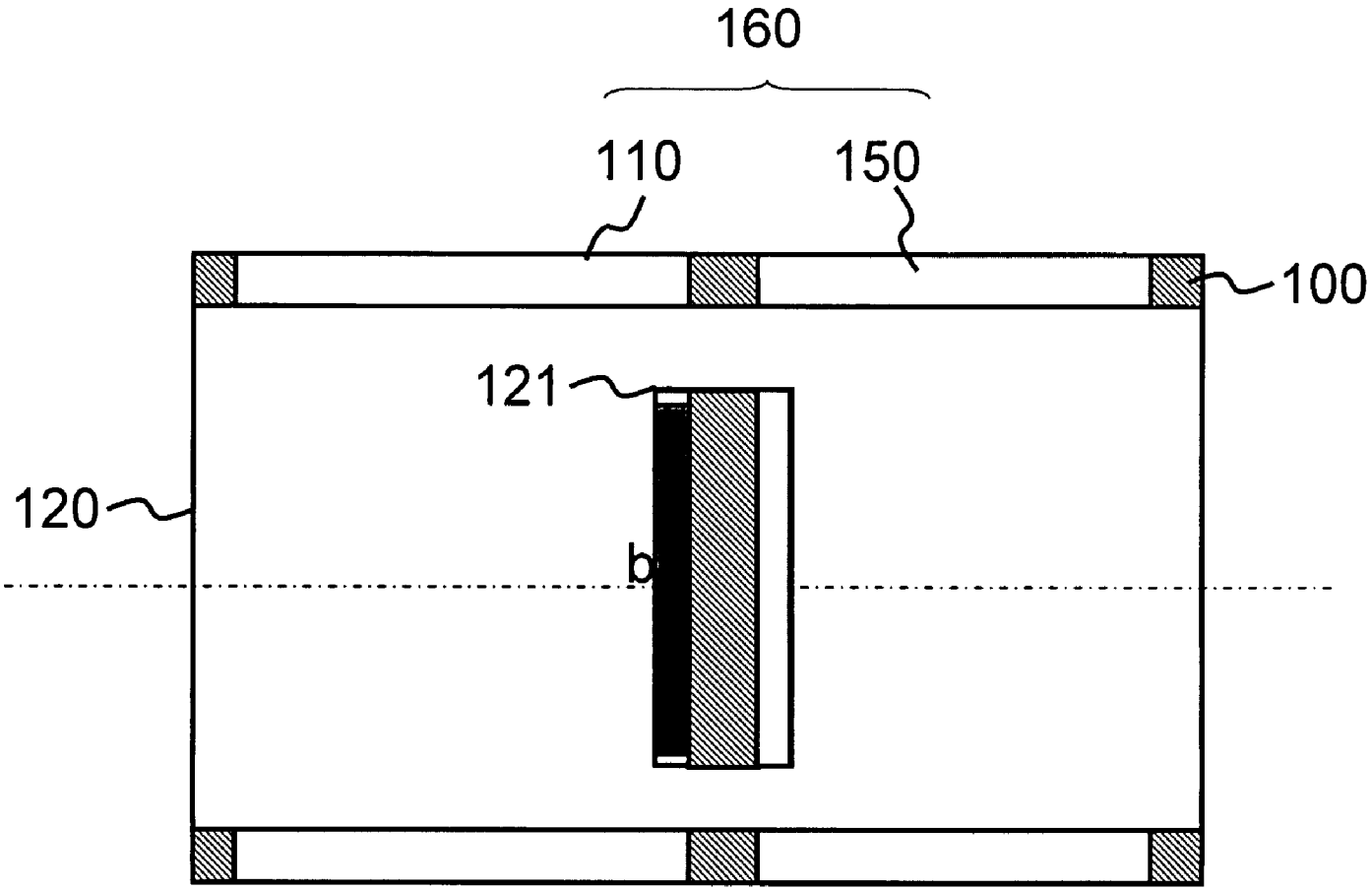

Referring to FIGS. 4A and 4B, a quadrode field emission display according to a first embodiment of the invention includes an insulation substrate 100, a cathode and sub-gate layer 160, a gate layer 120, a dielectric layer 130 and an anode plate 140. The cathode and sub-gate layer 160 include a cathode plate 110, and a sub-gate electrode 150 as a fourth electrode. The insulation substrate 100 as a cathode substrate may be made of glass substrate, plastic substrate or other suitable material.

The cathode plate 110 is disposed on the insulation substrate 100, and is formed with a cathode electrode layer 111, a resistive layer 112 and an emitter 113. The emitter 113 provided as a cathode emitter is connected in series, and coupled to first voltage level. The emitter 113 is made of a conductive material, which is flaky, clubbed or tubular, is coated with carbon materials, and is formed on the resistive layer 112. The carbon material is selected from a nano carbon material, a diamond, a diamond-like carbon material and the like.

The gate layer 120 disposed above the cathode plate 110 has an opening 121 that is pierced through the gate layer 120, exposes an edge a of the cathode plate 110, and is coupled to second voltage level, where the second voltage level is slightly higher than the first voltage level, such that the emitter 113 of the cathode plate 110 is induced to emit electrons. Therefore, the electric field intensity is raised so as to induce the emitter 113 to emit the electrons. The gate layer 120 may be made of a conductive material, such as a refractory metal like molybdenum (Mo), niobium (Nb), chromium (Cr), hafnium (Hf) or their composites or carbides. Further, the dielectric layer 130 is disposed below the gate layer 120 to separate the gate layer 120 from the cathode plate 110.

The anode plate 140 is formed above the gate layer 120 at a distance, and comprises a light-transmitting substrate 141, an anode electrode layer 142 and a light emitting layer 143. In this case, the light-transmitting substrate 141 is a glass substrate. The transparent anode electrode layer 142 is formed down the light-transmitting substrate 141 and coupled to a third voltage level, where the third voltage level is higher than the first and second voltage levels. The anode electrode layer 142 is made of indium tin oxide (ITO) or tin oxide (TO). The light emitting layer 143 is formed on the anode electrode layer 142. In this case, the light emitting layer 143 is a fluorescent layer or a phosphorous layer.

The sub-gate electrode 150 is apart from the cathode plate 110 at a distance, and they are simultaneously made on the insulation substrate 100. The sub-gate electrode 150 is coupled to a fourth voltage level, and the fourth voltage level is higher than the first and second voltage levels and lower than the third voltage level. Therefore, not only is the electric field intensity enhanced to assist the emitter 113 in emitting electrons, but the electrons from the emitter 113 are received in the dark to prevent undesired luminescence.

Accordingly, in the vacuum, the emitter 113 emits electrons as an electric field produced as the second, third and fourth voltage levels attract, and then the electrons collide with the light emitting layer 143 on the anode plate 140 through the opening 121 of the gate layer 120, such that the light emitting layer 143 excites light traveling through the light-transmitting substrate 141 and emits it. In order for the electrons emitted by the emitters 113 of the foregoing cathode plate 110 to collide with the light emitting layer 143, the electric field needs to be induced between the anode plate 140 and the emitter 113. In this case, the gate layer 120 and the sub-gate electrode 150 are closer to the emitters 113 than the anode plate 140, so the second and fourth voltage levels are applied to assist in exciting the electrons such that the FED is driven by a lower driving voltage. With respect to the quadrode FED of this embodiment, the edge of the emitter 113 is exposed so as to create the higher electric field intensity, thereby reducing the driving voltage substantially.

Furthermore, when the quadrode FED is in the dark, the electrons emitted by the emitter 113 not are emitted to the anode plate 140, but flow into the sub-gate electrode 150 since only the sub-gate electrode 150 is supplied with the voltage of the fourth voltage level, and therefore don't collide with the anode plate 140 to give off light. That is, since there is the sub-gate electrode 150 in the quadrode FED of this embodiment, the perfect display in the dark is achieved.

In this embodiment, in the test of the electric field distribution, it is discovered that the electric field at the edge d of the cathode plate 210 is 2 times that at the non-edge c, as shown in FIG. 5. As a result, the quadrode field emission display according to this embodiment enables effective increase in the electric field. Therefore, the objective of reducing the driving voltage is achieved.

Figure 5A:
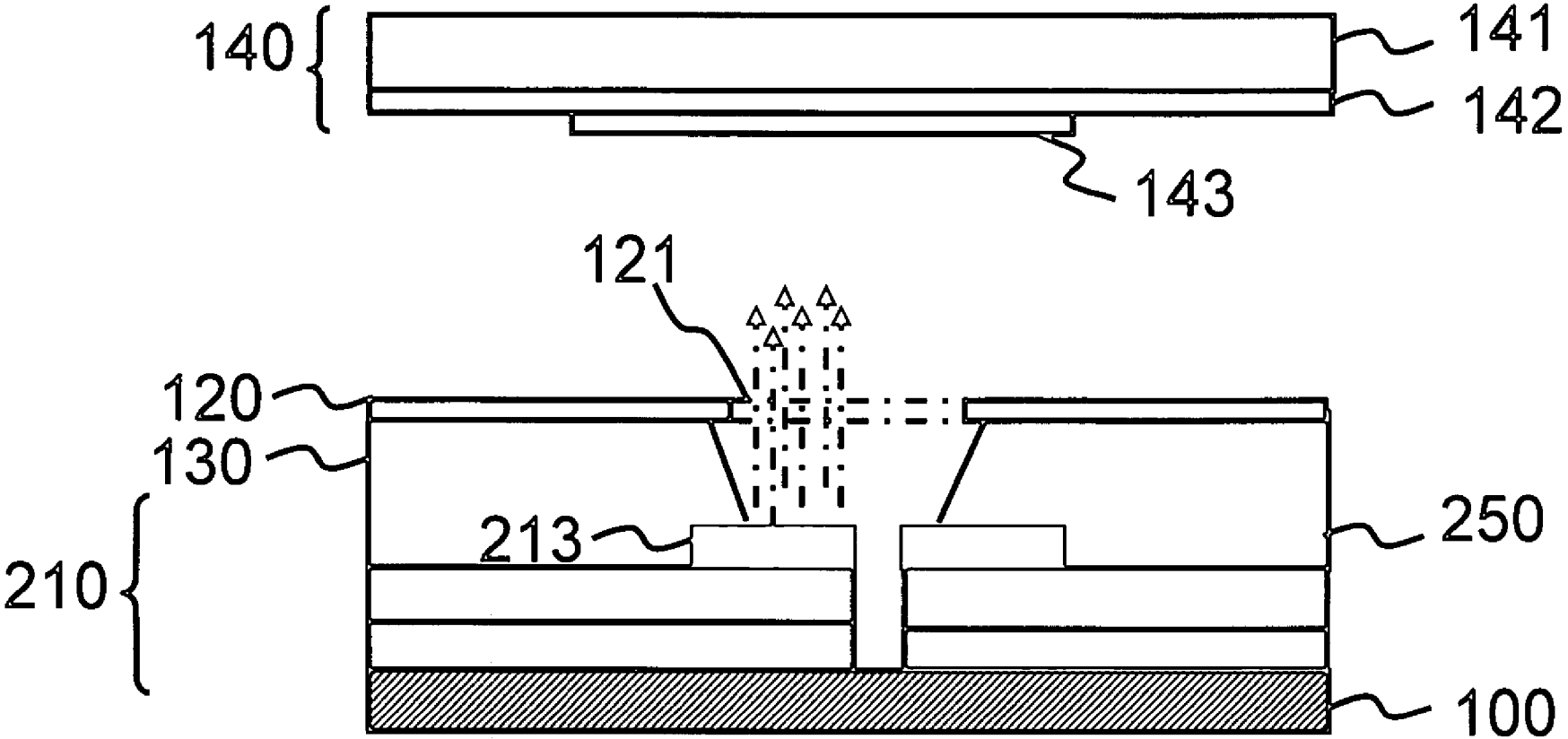
FIGS. 5A and 5B are a cross-sectional view and an upward view showing a quadrode field emission display according to a second embodiment of the invention, respectively.
Figure 5B:
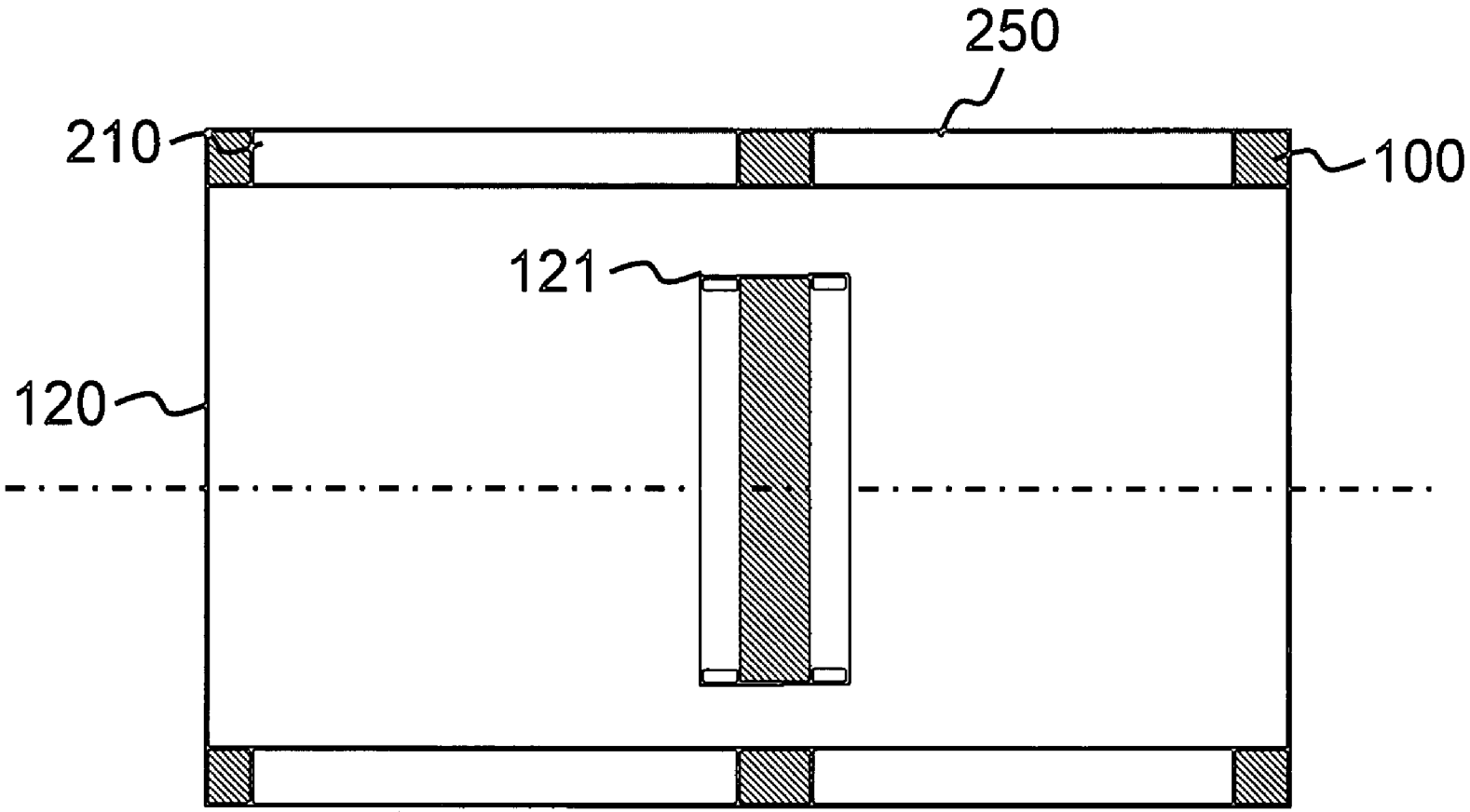

Also, referring to FIGS. 5A and 5B showing a quadrode FED according to a second embodiment of the invention, a process for a sub-gate electrode 250 is the same as that for the cathode plate 210.

Figure 6:
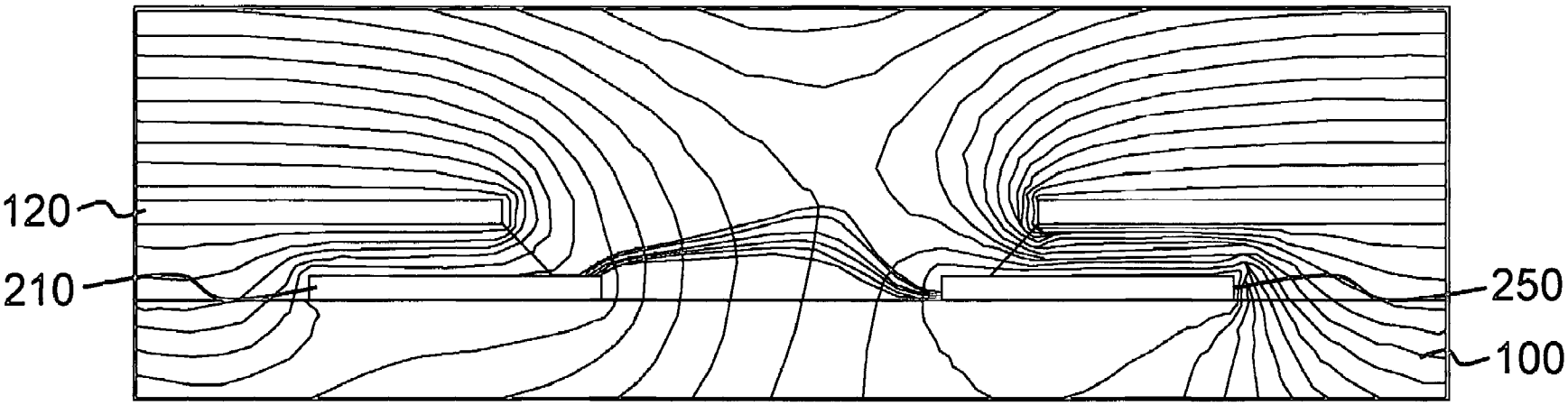
FIG. 6 is an electric field profile of the quadrode field emission display according to a second embodiment of the invention in the dark.

With reference to FIG. 6, showing an electric field profile of the quadrode FED of this embodiment in the dark, since there is the sub-gate electrode 250 such that all electrons emitted by an emitter 213 flow into the sub-gate electrode 250, the quadrode FED of this embodiment is in a state of total dark, and does not cause any light leakage.

As described above, the quadrode FED according to invention adds a fourth electrode therein besides originally having a cathode, a gate electrode and an anode, such that the electric field is enhanced by the fourth electrode to more easily excite the electrons, thereby reducing the driving voltage. The fourth electrode assists in driving the FED to display in the dark, improving image quality. Furthermore, the fourth electrode and the cathode are simultaneously made to simplify the steps of whole process. The invention exposes the edge of the cathode layer through the opening of the gate layer with respect to the electrical characteristics that the edge structure may raise the electric field intensity, to enhance the electric field at the emitter, thereby reducing the driving voltage substantially and accelerating the development of the driving system.

Certain variations will be apparent to those skilled in the art, and these variations are considered within the spirit and scope of the claimed invention.

What is claimed is:

1. A quadrode field emission display, comprising:

an insulation substrate;

a cathode and sub-gate layer comprising a cathode plate and a sub-gate electrode, the cathode plate and the sub-gate electrode disposed on a surface of the insulation substrate, the cathode plate being apart from the sub-gate electrode at a distance, the sub-gate electrode having a voltage level higher than a voltage level of the cathode plate normally, thereby attracting and leading electrons released from the cathode plate into the sub-gate electrode;

a gate layer disposed above the cathode and the sub-gate layer, the gate layer having an opening corresponding to an edge of the cathode plate, the opening pierced through the gate layer to expose the edge of the cathode plate, so as to induce the cathode plate to excite a plurality of electrons;

a dielectric layer, one portion of the dielectric layer disposed between the cathode plate and the gate layer, the other portion of the dielectric layer disposed between the sub-gate electrode and the gate layer, so as to respectively separate the cathode plate and the sub-gate electrode from the gate layer; and an anode plate disposed above the gate layer, so that the excited electrons are emitted and collide with the anode plate.

2. The quadrode field emission display of claim 1, wherein the opening exposes simultaneously the edge of the cathode plate and an edge of the sub-gate electrode

3. The quadrode field emission display of claim 1, wherein the anode plate comprises:

a light-transmitting substrate;

an anode electrode layer formed under the light-transmitting substrate; and a light emitting layer formed under the anode electrode.

4. The quadrode field emission display of claim 3, wherein the light emitting layer is selected from the group consisting of a fluorescent layer and a phosphorous layer.

5. The quadrode field emission display of claim 1, wherein the cathode plate, the gate layer and the anode plate are respectively coupled to a first voltage level, a second voltage level, and a third voltage level, wherein the third voltage level is higher than the second voltage level, and the second voltage level is higher than the first voltage level.

6. The quadrode field emission display of claim 5, wherein the sub-gate electrode is coupled to a fourth voltage level, wherein the fourth voltage level is higher than the first and the second voltage levels and is lower the third voltage level.

7. The quadrode field emission display of claim 1, wherein the cathode plate comprises:

a cathode electrode layer;

a resistive layer formed on the cathode electrode layer; and an emitter formed on the resistive layer.

8. The quadrode field emission display of claim 7, wherein the emitter is made of a conductive material coated with carbon materials.

9. The quadrode field emission display of claim 8, wherein the carbon material is selected from the group consisting of a nano carbon material, a diamond, and a diamond-like carbon material.

* * * * *